US010011954B1

(12) United States Patent
Martin

(10) Patent No.: US 10,011,954 B1
(45) Date of Patent: Jul. 3, 2018

(54) RAIL SEAT CROWN AND CONCRETE RAIL TIE HAVING THE SAME

(71) Applicant: John K Martin, Calgary (CA)

(72) Inventor: John K Martin, Calgary (CA)

( * ) Notice: Subject to any disclaimer, the term of this patent is extended or adjusted under 35 U.S.C. 154(b) by 0 days.

(21) Appl. No.: 15/459,279

(22) Filed: Mar. 15, 2017

(51) Int. Cl.
*E01B 3/42* (2006.01)
*E01B 3/40* (2006.01)
*E01B 9/04* (2006.01)

(52) U.S. Cl.
CPC ..... *E01B 3/40* (2013.01); *E01B 3/42* (2013.01); *E01B 9/04* (2013.01)

(58) Field of Classification Search
CPC ..... E01B 3/32; E01B 3/24; E01B 3/42; E01B 1/004; E01B 1/005; E01B 3/26; E01B 9/18; E01B 3/40; E01B 9/04; E01B 3/28
USPC ..... 238/111, 113, 115, 116, 265, 269, 270, 238/271, 264, 349, 351
See application file for complete search history.

(56) References Cited

U.S. PATENT DOCUMENTS 1,011,335 A * 12/1911 Plaig ..... E01B 3/16 238/265
4,098,460 A * 7/1978 Olivier-Martin ..... E01B 3/34 238/85
7,690,584 B2 * 4/2010 Geissele ..... E01B 9/303 238/264

FOREIGN PATENT DOCUMENTS

JP 2001-253745 * 9/2001

OTHER PUBLICATIONS

JP2001-253745 (English description), Sep. 2001.*

* cited by examiner

*Primary Examiner* — Mark T Le
(74) *Attorney, Agent, or Firm* — Lewellyn Law, PLLC; Stephen Lewellyn

(57) ABSTRACT

A concrete rail tie has an elongated tie body made of a first concrete material. The elongated tie body has an elongated top surface having a shaped profile. A preformed rail seat crown made of a second concrete material is embedded in the elongated tie body and disposed at a rail seat location of the elongated tie body. The preformed rail seat crown has top side flush with and shaped to match the shaped profile of the elongated top surface of the elongated tie body. And the second concrete material has a greater compressive strength and a greater flexural strength than the first concrete material.

10 Claims, 5 Drawing Sheets

RAIL SEAT CROWN AND CONCRETE RAIL TIE HAVING THE SAME

BACKGROUND OF THE INVENTION

Field of the Invention

The present invention relates generally to railroad ties, and more particularly, relating to prestressed concrete railroad rail ties having a rail seat capable of reducing rail seat damage.

Description of the Related Art

Prestressed concrete railroad ties have a problem of flexural cracking at the rail seat, which is caused by rail seat impact loading. One solution to prevent or reduce impact loading is to position a seat pad between the rail and the real seat of the tie to attenuate the impact loads and vibrations resulting from the passage of railroad vehicles over the rail. When the wheels pass over the tie, the seat pad is momentarily compressed to attenuate the load. In heavy haul situations, the repeated cycle of compression and release of downward pressure on the seat pad abrades the rail seat of the tie and overtime creates an undesirable void under the pad and rail, which is commonly referred to as rail seat abrasion.

To repair rail seat abrasion, the track structure must be taken out of service so that the rail pad can be replaced with a thicker pad to compensate for the loss of cement and restore the track to the proper gauge. This is process is repeated ever three to five years to achieve maximum tie life expectancy of about twenty-five years. Replacing seat pads due to rail seat abrasion is very time consuming and results in downtime and loss of revenue for the railroads when the track is out of service.

SUMMARY OF THE INVENTION

Embodiments of the present invention overcome the problem of rail seat abrasion by providing a rail seat crown that is capable of resisting rail seat abrasion.

Embodiments of the present invention overcome the problem of rail seat abrasion by providing a concrete rail tie having a preformed rail seat crown embedded in a concrete rail tie.

In general, in one aspect, a preformed rail seat crown to be cast integral with a concrete rail tie is provided. The preformed rail seat crown has top side that is shaped to match the profile of a top surface of a concrete rail tie and the preformed rail seat crown made entirely of metal fiber-reinforced concrete.

In general, in another aspect, a concrete rail tie is provided. The concrete rail tie has an elongated tie body made of a first concrete material. The elongated tie body has an elongated top surface having a shaped profile. A preformed rail seat crown made of a second concrete material is embedded in the elongated tie body and disposed at a rail seat location of the elongated tie body. The preformed rail seat crown has top side flush with and shaped to match the shaped profile of the elongated top surface of the elongated tie body. And the second concrete material has a greater compressive strength and a greater flexural strength than the first concrete material.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings.

DETAILED DESCRIPTION OF THE INVENTION

Figure 1:
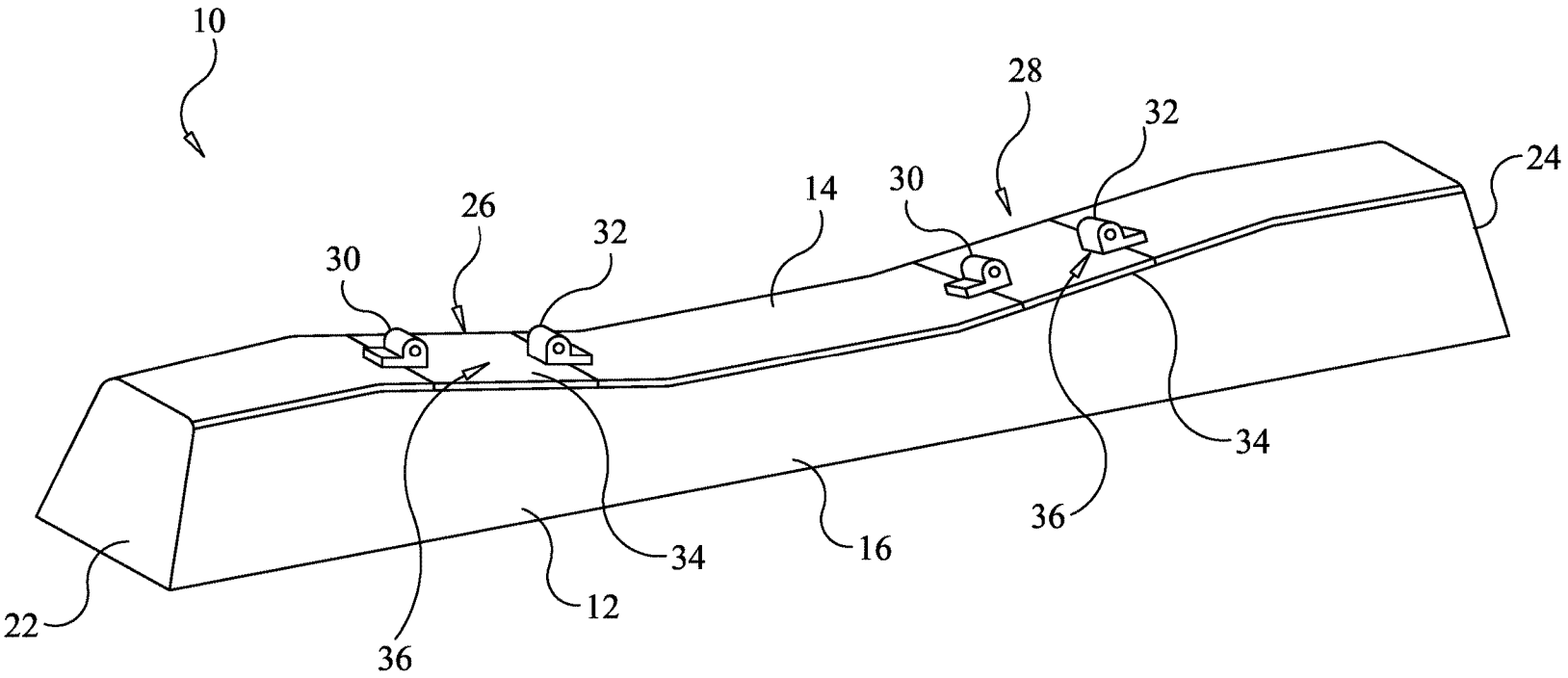
FIG. 1 is a perspective view of a concrete rail tie constructed in accordance with the principles of an embodiment of the present invention.
Figure 2:
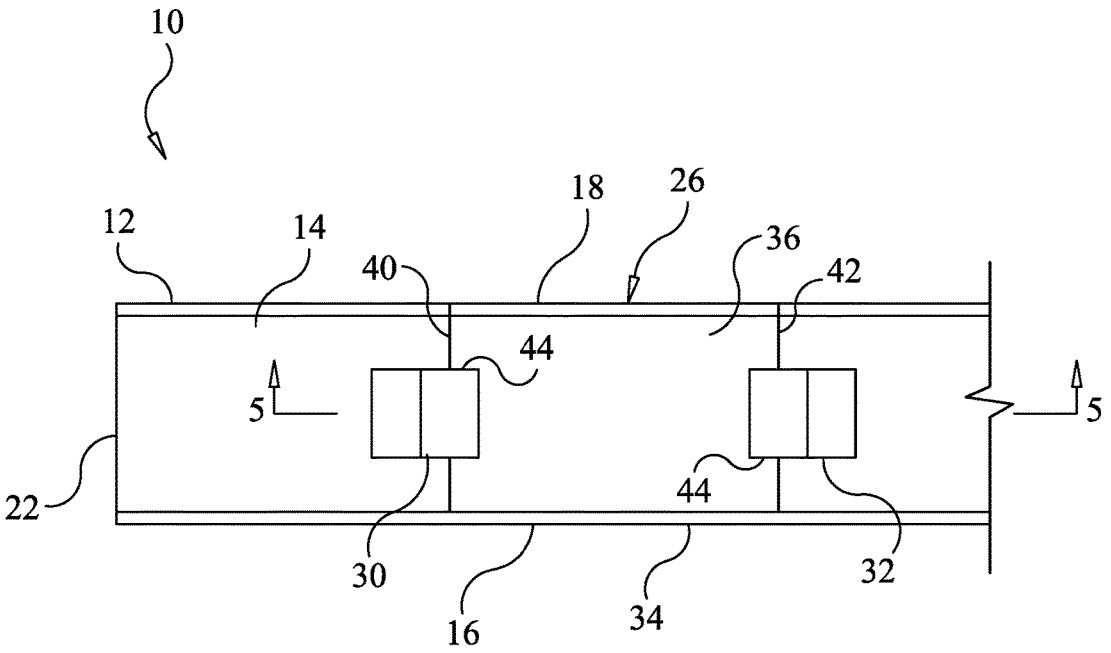
FIG. 2 is a partial top plan view of the concrete rail tie of FIG. 1.
Figure 3:
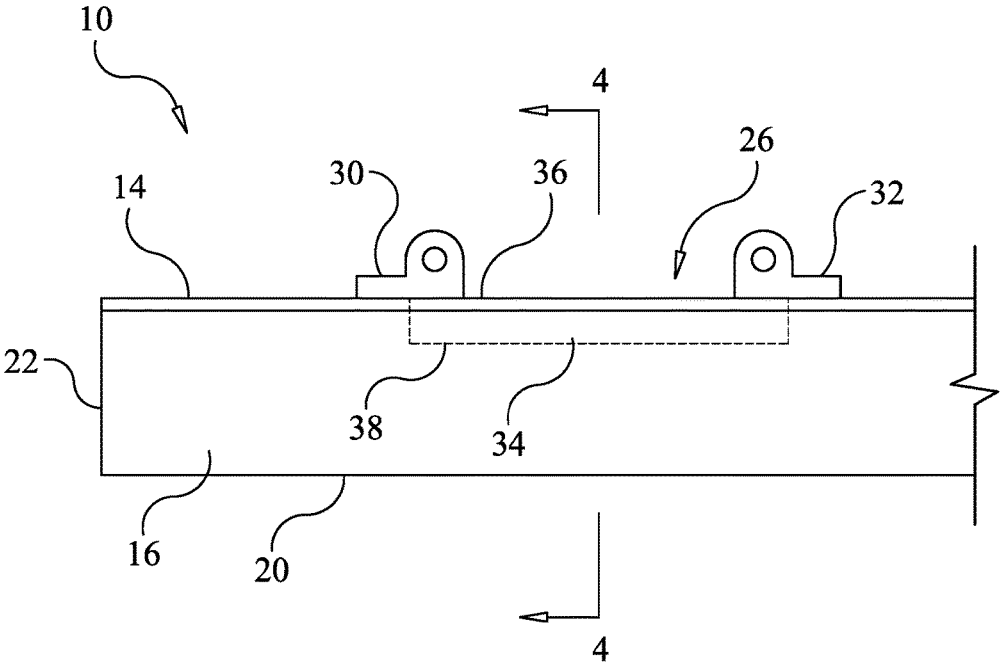
FIG. 3 is a partial side elevational view of the concrete rail tie of FIG. 1.
Figure 4:
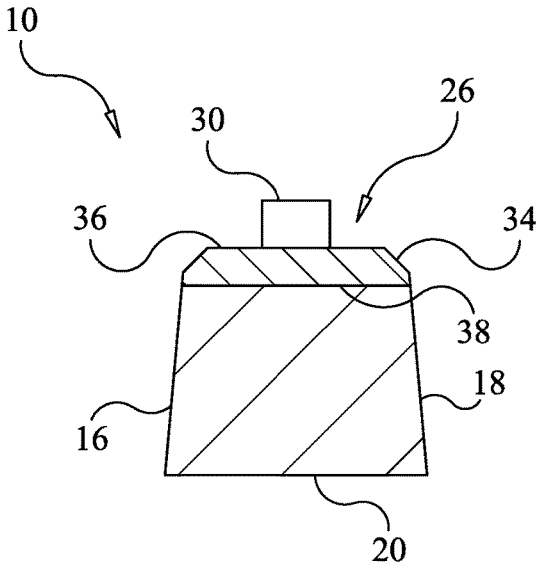
FIG. 4 is a cross-section view taken along line 4-4 in FIG. 3.
Figure 5:
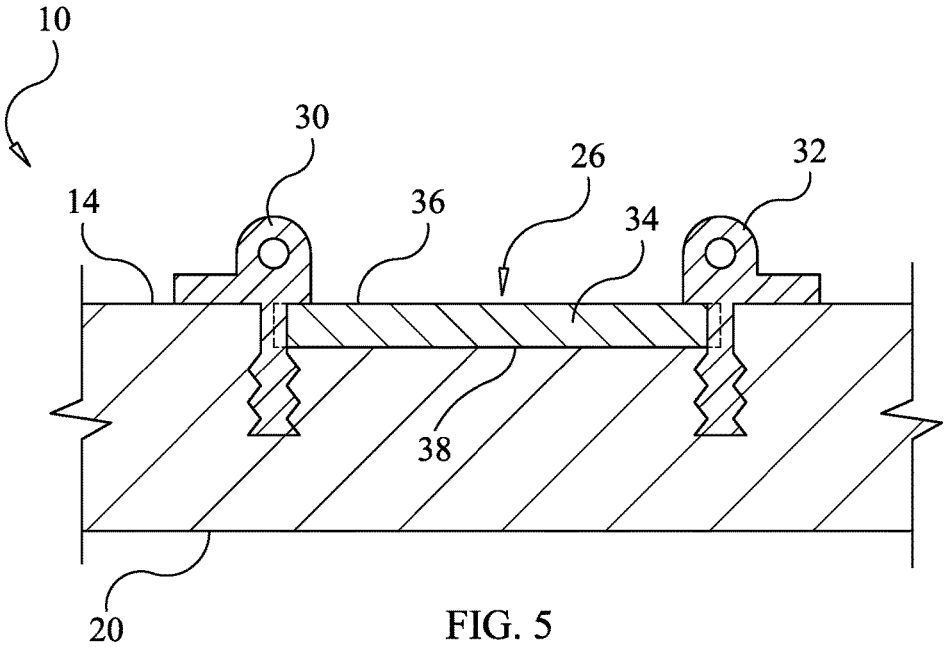
FIG. 5 is a cross-section view taken along line 5-5 in FIG. 2.

In FIGS. 1 through 5, there is representatively illustrated a new concrete railroad tie 10 in accordance with an embodiment of the present invention. The tie 10 includes an elongated tie body 12 defined by an elongated top surface 14, a pair of opposing elongated side surfaces 16 and 18, an elongated bottom surface 20, and a pair of opposing end surfaces 22 and 24 connecting the lateral edges of the top, side, and bottom surfaces.

The tie body 12 has generally a trapezoidal cross-section such that at any point along the length of the tie body, the width of the top surface 14 is lesser than that of the bottom surface 20. The tie body 12 is made of a concrete material, preferably prestressed concrete.

The tie body 12 includes a pair of rail seat sections 26 and 28 that are laterally spaced along the length of the tie body. Each rail seat section includes a pair of rail clip shoulders 30 and 32 that laterally spaced and disposed on opposite sides of the rail seat section. The rail clip shoulders are embedded into the tie body 12 and are adapted to removably receive rail clips to hold a rail in position on the rail seat section.

The tie 10 further includes a rail seat crown 34 located at each rail seat section 26 and 28. The rail seat crown 34 is preformed and embedded into the tie body 12 during casting and is disposed between the rail clip shoulders 30 and 32. In the depicted embodiment, the top side 36 of the rail seat crown 34 is flush with the top surface 14 of the tie body 12. Additionally, in the depicted embodiment, the top side 36 of the rail seat crown 34 is shaped to match the profile of the top surface 14 of the tie body 12. In other embodiments, depending upon the application, it may be desirable for the top side 36 of the rail seat crown 34 to be shaped differently from the profile of the top surface 14 of the tie body 12.

The rail seat crown 34 further includes a bottom side 38 that is opposite of the top side 36 and is flat surface. The rail seat crown 34 further includes a pair of opposite lateral edges 40 and 42 each having a notch 44 in which is disposed a rail clip shoulder 30 and 32, respectively, of said elongated tie body 12. The engagement between the rail clip shoulders 30 and 32 and notch 44 of each lateral edge 40 and 42 hold the rail seat crown 34 in position and prevents lateral movement of the rail seat crown.

The rail seat crown 34 is made of a different material from the material that the tie body is constructed. Particularly, the rail seat crown 34 is made of a material that has a higher compressive strength and flexural strength than that of the material forming the tie body. For example, the compressive strength of the material forming the tie body may be between 15 to 50 MPa, whereas the compressive strength of the material forming the rail seat crown 34 may be between 100 and 150 MPa. Addition, the flexural strength of the material forming the tie body may be between 3 and 7 MPa, whereas the flexural strength of the material forming the seat crown 34 may be between 20 and 50 MPa. Further, the material forming the rail seat crown 34 may be reinforced by metal fiber or other fibers material. In an embodiment, the metal fiber may be stainless steel metal fiber. A suitable material for the rail seat crown is described in U.S. Pat. Nos. 8,303,708; 6,887,309; 6,478,867 or 6,723,162, the entirety of each is incorporated herein by reference.

Figure 6:
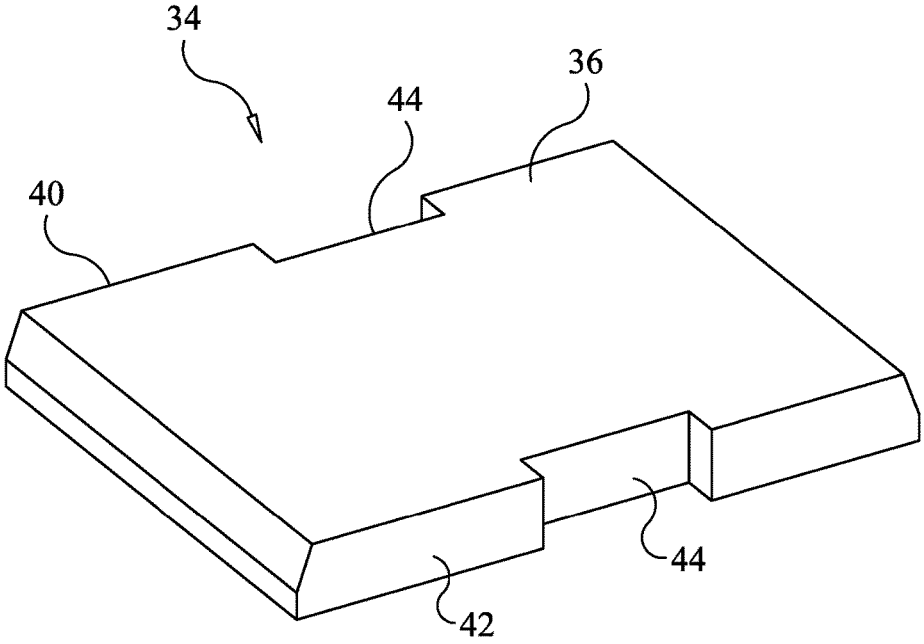
FIG. 6 is a top perspective view of a preformed rail seat crown construction in accordance with the principles of an embodiment of the present invention.
Figure 7:
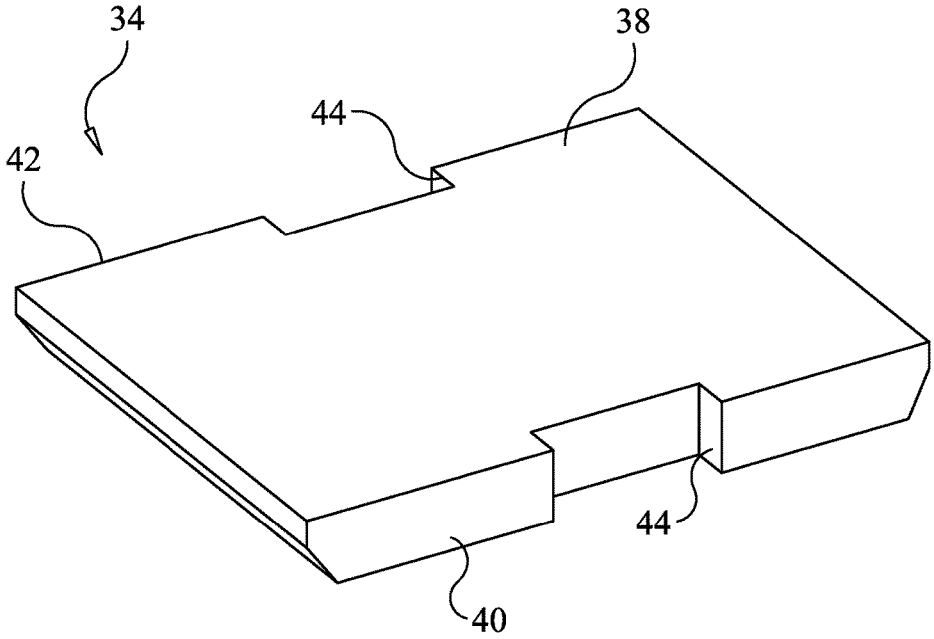
FIG. 7 is a bottom perspective view of the preformed rail seat crown of FIG. 6.

In FIGS. 6 and 7, the rail seat crown 34 is shown separate from the rail tie 10 and illustrates the top side 36, the bottom side 38, the lateral edges 40 and 42, and the notch 44 formed through each lateral edge.

The rail seat crown 34 is preformed prior to casting the rail tie body 12 and is placed into the mold used to cast the rail tie body 12, such that the rail seat crown is embedded into the rail tie body in the manner described above. In application, the preformed rail seat crown 34 prevents rail seat abrasion caused by the cyclic compression and release of the rail seat pad disposed between the rail and the top surface 36 of the rail seat crown.

Figure 8:
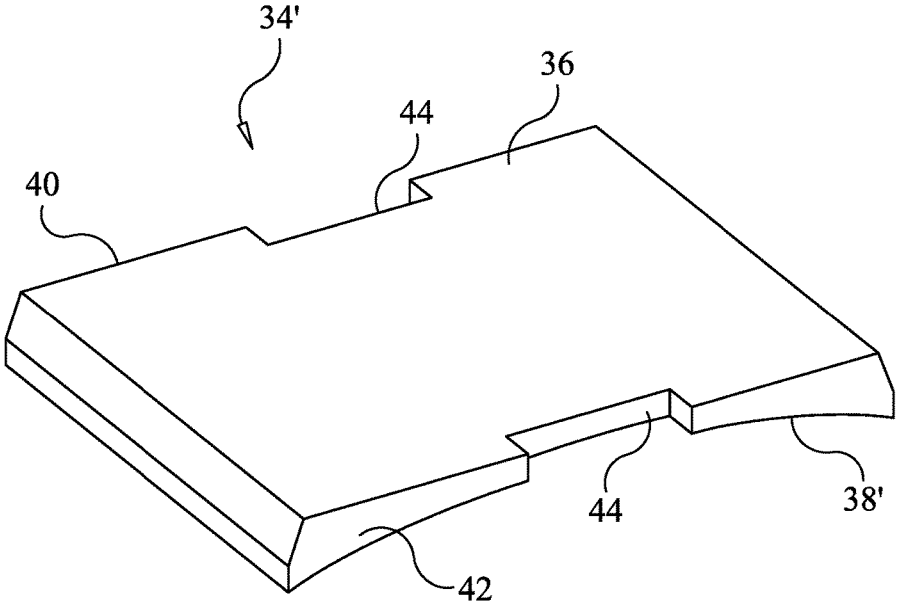
FIG. 8 is a top perspective view of a preformed rail seat crown construction in accordance with the principles of an embodiment of the present invention.
Figure 9:
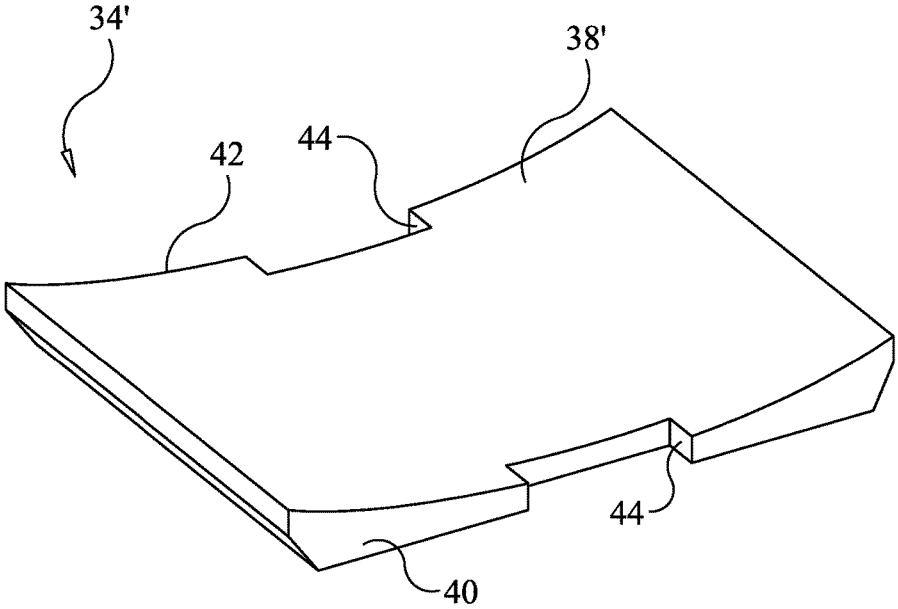
FIG. 9 is a bottom perspective view of the preformed rail seat crown of FIG. 8.

In FIGS. 8 and 9, there is representatively illustrated a rail seat crown 34' according to a second embodiment. Rail seat crown 34' is substantially similar to rail seat crown 34 except bottom side 38' is concaved shape. The bottom side 38' being concaved allows for the rail seat crown 34' to be more securely embedded within the rail tie body 12. That is, the concaved shape of the bottom side 38' prevents the rail seat crown 34' from shifting relative the rail tie body 12, that otherwise may happen with a flat bottom side.

Several embodiments of the present invention have been described. Nevertheless, it will be understood that various modifications may be made without departing from the spirit and scope of the invention. Accordingly, other embodiments are within the scope of the following claims.

What is claimed is:

1. A concrete rail tie comprising:

an elongated tie body made of a first concrete material, said elongated tie body having an elongated top surface having a shaped profile;

a preformed rail seat crown made of a second concrete material, said preformed rail seat crown embedded in said elongated tie body and disposed at a rail seat location of said elongated tie body, said preformed rail seat crown having top side flush with and shaped to match said shaped profile of said elongated top surface of said elongated tie body;

wherein said second concrete material has a greater compressive strength and a greater flexural strength than said first concrete material; and wherein the compressive strength of the first concrete material is between 15 and 50 MPa, the flexural strength of the first concrete material is between 3 and 7 MPa, the compressive strength of the second concrete material is between 100 and 150 MPa, and the flexural strength of the second concrete material is between 20 and 50 MPa.

2. The concrete rail tie of claim 1, wherein said preformed rail seat crown has a pair of opposite lateral edges each having a notch in which is disposed a rail clip shoulder of said elongated tie body.

3. The concrete rail tie of claim 1, wherein said second concrete material is reinforced by metal fibers.

4. The concrete rail tie of claim 3, wherein said metal fibers are stainless steel metal fibers.

5. The concrete rail tie of claim 1, wherein said first concrete material is prestressed concrete.

6. The concrete rail tie of claim 1, wherein said preformed rail seat crown further included a concaved shaped bottom side.

7. A concrete rail tie comprising:

an elongated tie body made of a first concrete material, said elongated tie body having an elongated top surface having a shaped profile;

a preformed rail seat crown made of a second concrete material, said preformed rail seat crown embedded in said elongated tie body and disposed at a rail seat location of said elongated tie body, said preformed rail seat crown having top side flush with and shaped to match said shaped profile of said elongated top surface of said elongated tie body, said preformed rail seat crown having a pair of opposite lateral edges each having a notch in which is disposed a rail clip shoulder of said elongated tie body;

wherein said second concrete material has a greater compressive strength and a greater flexural strength than said first concrete material;

wherein said second concrete material is reinforced by metal fibers; and wherein the compressive strength of the first concrete material is between 15 and 50 MPa, the flexural strength of the first concrete material is between 3 and 7 MPa, the compressive strength of the second concrete material is between 100 and 150 MPa, and the flexural strength of the second concrete material is between 20 and 50 MPa.

8. The concrete rail tie of claim 7, wherein said metal fibers are stainless steel metal fibers.

9. The concrete rail tie of claim 7, wherein said first concrete material is prestressed concrete.

10. The concrete rail tie of claim 7, wherein said preformed rail seat crown is entirely made of said second material.

* * * * *